US005518404A

United States Patent [19]

Steele

[11] Patent Number: 5,518,404

[45] Date of Patent: May 21, 1996

[54] TALKING DOOR KNOB ASSEMBLY

[76] Inventor: Patrick T. Steele, 5120 Woodwind La., Anaheim, Calif. 92807

[21] Appl. No.: 336,509

[22] Filed: Nov. 9, 1994

[51] Int. Cl.[6] ..... E05B 1/00

[52] U.S. Cl. ..... 434/238; 292/347

[58] Field of Search ..... 70/DIG. 49; 434/236–238; 292/347, DIG. 2; 340/546, 547

[56] References Cited

U.S. PATENT DOCUMENTS

| | | | |
|---|---|---|---|
| 3,024,555 | 3/1962 | Abeles | 292/347 X |
| 4,339,747 | 7/1982 | Maybee | 340/547 |
| 4,981,314 | 1/1991 | Carr | 292/347 |

*Primary Examiner*—Richard J. Apley
*Assistant Examiner*—Glenn E. Richman
*Attorney, Agent, or Firm*—Robert R. Meads

[57] ABSTRACT

A talking door knob assembly which provides a decoratively shaped character familiar to a child as an inner door knob of a door to a child's room and complementary to the room decor, which responds to a rotation of the door knob by activating any of a plurality of pre-recorded messages associated with the character forming the door knob. The door knob may be formed in the image of any of a large variety of figures such as sports figures, nursery rhyme characters or other currently popular child characters. In addition to annunciating entertaining sounds or messages, the invention may provide messages for the safety and training of a child.

9 Claims, 5 Drawing Sheets

TALKING DOOR KNOB ASSEMBLY

BACKGROUND OF THE INVENTION

The present invention relates to a decoration for a child's room and more particularly to a door knob assembly shaped in the form of a character of interest to a child and which automatically transmits one of a plurality of entertaining and educational pre-recorded audio messages internally contained within and associated with the character.

In childrens' rooms, decorators and parents usually take great care to create a particular friendly decor and environment. Window covering design, bedspreads, pillow covers, rugs, furniture, wall covering, pictures and even light switch cover plates are selected for the purpose of creating a place of interest and entertainment for the child. However, the door knobs on the doors for the child's room have in the past been devoid of decorative and entertaining influence. Also, for safety reasons, it is desirable for the parents or careperson to be able to detect when their child enters and leaves the room. Therefore, there is a need for a decorative talking door knob for the entertainment of the child as well as for providing an indication of the child's movement to the careperson. Further, a talking door knob assembly may provide educational information to the child. The present invention satisfies such needs.

The invention, therefore extends the utility of the door knob beyond the mere prior art functionality of controlling a door movement to an entertaining, educational and decorative device that may promote household safety as well.

SUMMARY OF THE INVENTION

The present invention provides a talking door knob assembly which may be chosen from an unlimited variety of forms or figures to complement the decor of a child's room. The figure images, for example, may be of sports figures, sports equipment, animals or children's cartoon or nursery rhyme characters. The messages transmitted by the door knob assembly are associated with the door knob figure and may comprise music, voice and/or sound effects selected to be entertaining, amusing as well as educational to a child. In addition, the transmission of the messages may also alert a parent or careperson when a toddler is leaving a room; a safety feature when the parent may be distracted by other household activity. Further, the messages may be selected as a training device for a child to encourage it to remember to open or close the door or as a reminder to perform some other action prompted by operating the door knob.

With the availability of microcircuits having sufficient memory, processing speed and low power requirements, digital speech and other sound synthesis has become practical. The present invention is self contained and uses such a microcircuit to store a plurality of audible messages. A switch sensitive to rotational operation of the door knob applies power from an energy source to the microcircuit. The microcircuit, following preprogrammed, stored digital instructions, selects and releases one of a plurality of digital data sets which is delivered as a data stream to a transducer wherein the electrical energy is converted to sound. The plurality of data sets may be synthesized voice messages, musical segments or other pre-recorded sounds.

DESCRIPTION OF THE PREFERRED EMBODIMENTS

Figure 1:
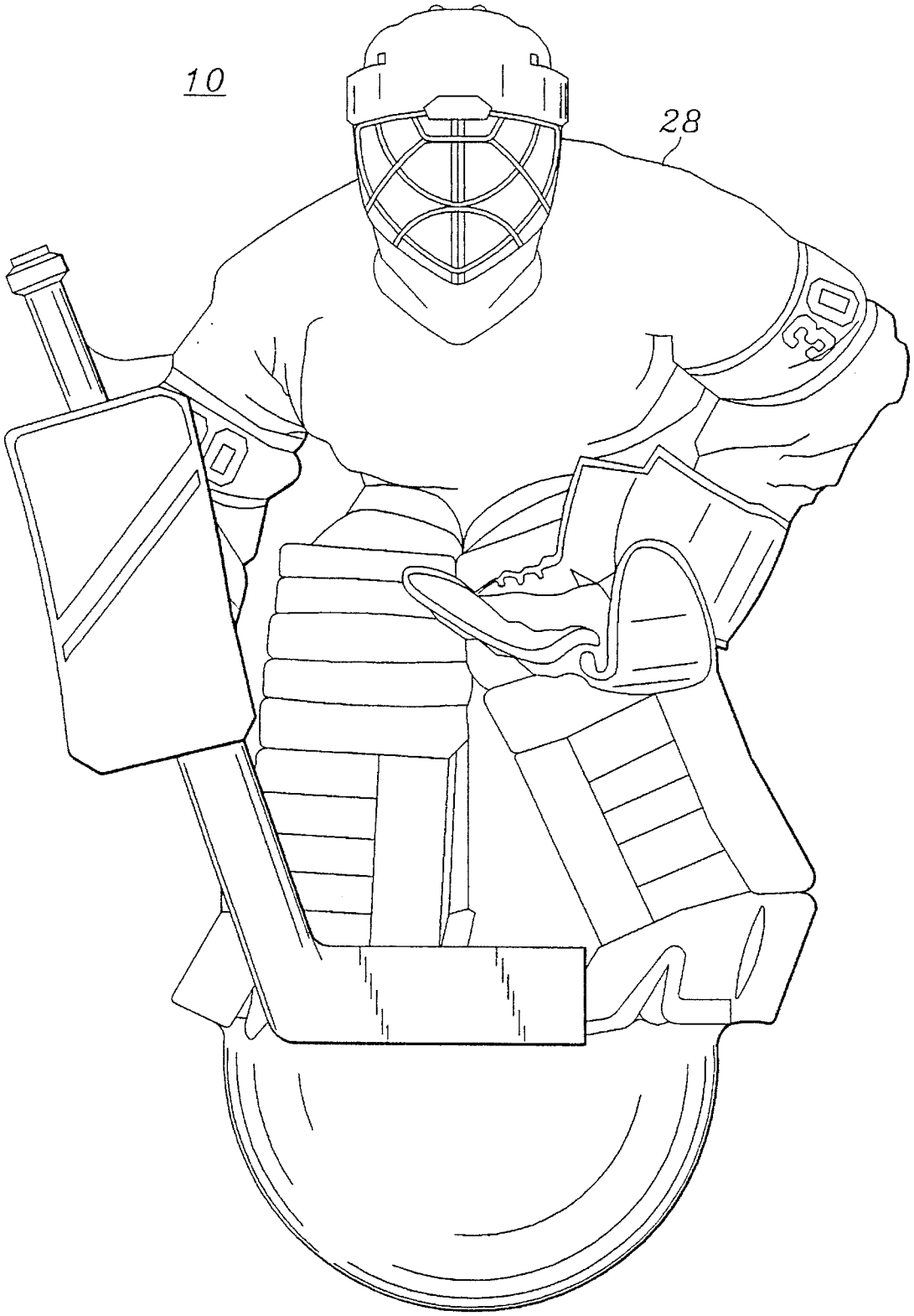
FIG. 1 shows a preferred embodiment of a front view of a hockey player image formed to be a talking door knob.
Figure 2:
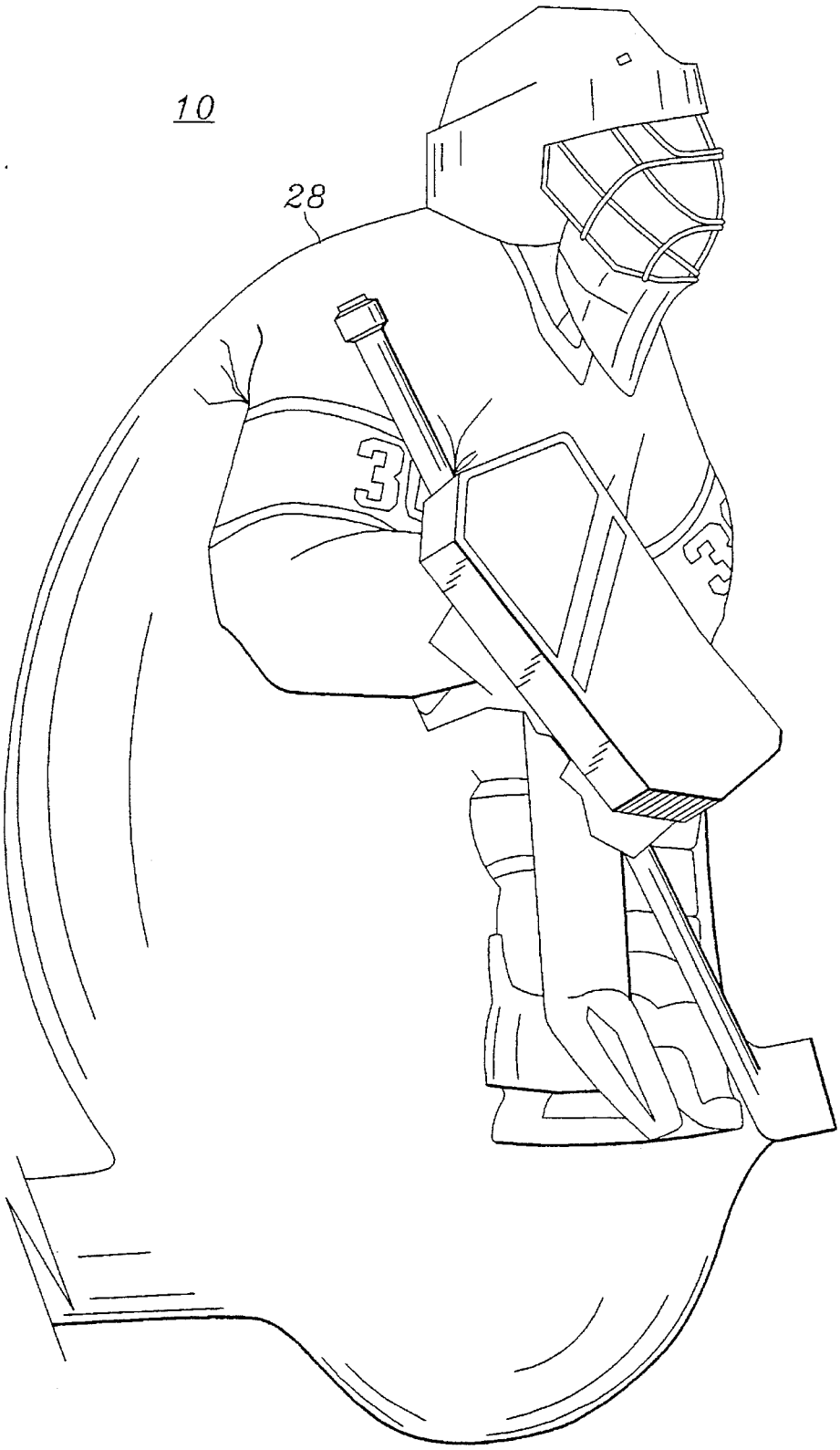
FIG. 2 shows a side view of the image of FIG. 1.
Figure 3:
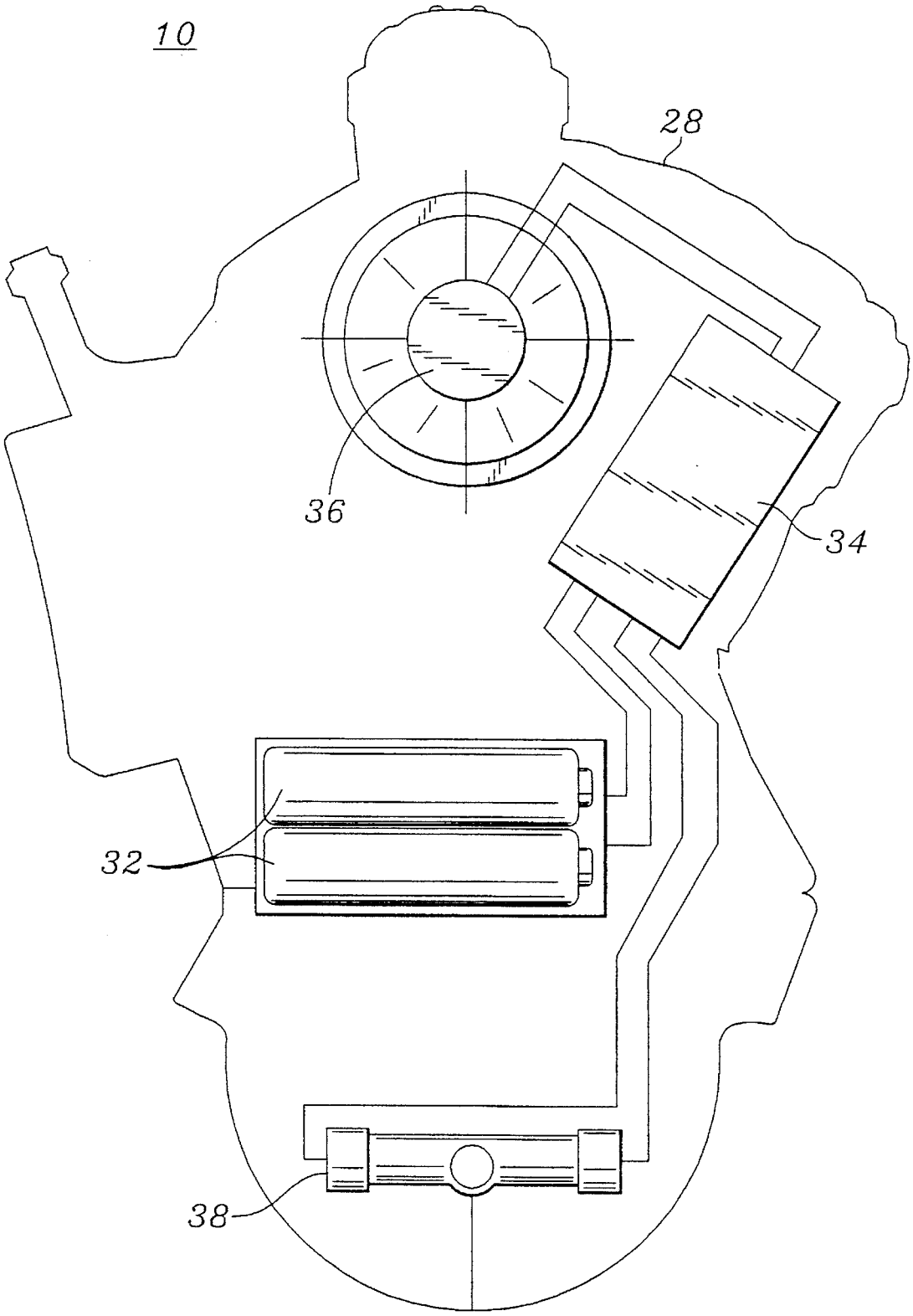
FIG. 3 shows a front view outline of the image as in FIG. 1 and placement of principal components of the preferred embodiment within the image volume.
Figure 4:
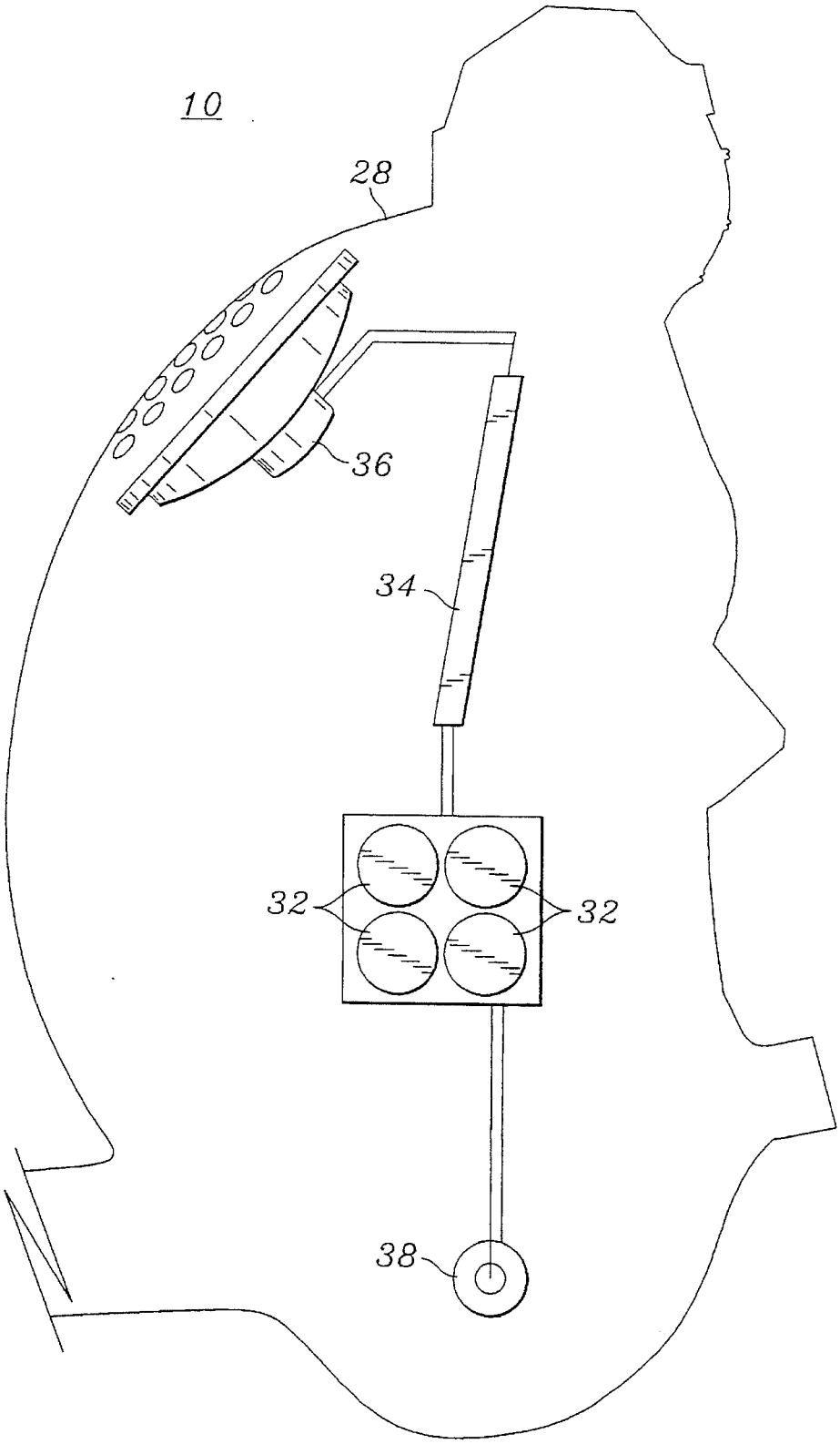
FIG. 4 shows a side view outline of the image of FIG. 3 and placement of principal components of the preferred embodiment within the image volume.
Figure 5:
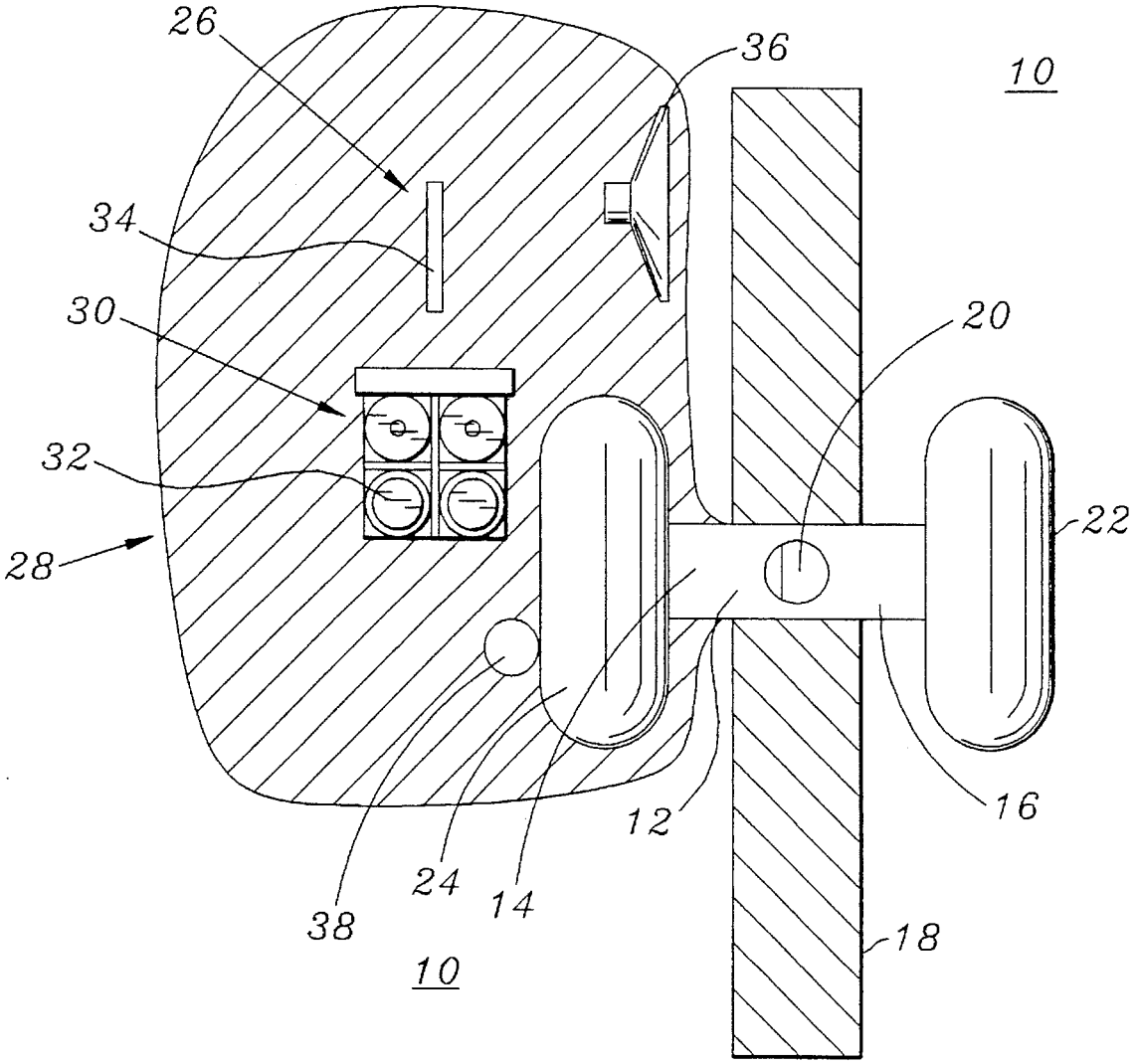
FIG. 5 shows a sectional end view of a segment of a door and the relationship of the preferred embodiment as assembled to the door.

A preferred embodiment of the present invention, as shown in FIGS. 1 through 5, is a talking door knob assembly 10 for enhancing the decor of a child's room, entertaining, educating and providing for protection of the child by knob rotation activated audio announcements. The talking door knob assembly 10 comprises of spindle shaft 12 for extending through and beyond opposite surfaces of a door 18 and operating a door latch 20. The shaft 12 supports an inner knob 24 on an inner end 14 and an outer knob 22 on an opposite outer end 16 of the shaft. The outer knob 22 may be of conventional design consistent with the decor of the associated area as shown in FIG. 5. The inner knob 24 is a turnable decorative knob shaped as a familiar childhood character or other item, shown in FIGS. 1 and 2, containing an audio message generating system 26 which projects an audio message into the child's room when rotationally activated.

In the preferred embodiment of FIGS. 1 through 4, the character is a hockey player 28 shaped of a molded plastic material and realistically painted. Alternatively, the character may be formed from a metallic material. Additionally, the character may be any other figure selected for the age of the child, such as a bear, mouse, puppy, cat, dinosaur or one of the more popular current cartoon characters.

Within the decorative character, as shown in FIGS. 3 and 4, are voids for containing and interconnecting the audio message generating components. Additionally, as shown in FIG. 5, a covered opening 30 in the side of the decorative character allows for replacement of the four dry cell batteries 32 (AA cells may be Eveready, Ray-O-Vac, Duracell, etc.) as used in this embodiment.

Within the decorative character as shown in FIGS. 3 and 4, a microcircuit chip 34 (Digital playback processor, DPP #864-20, Techno Mind, Inc. San Jose, Calif.) is mounted and connected to a speaker 36 and, through a position sensitive switch 38, to the batteries 32. The chip 34 is pre-programmed with as many as thirty messages, each of about 5 seconds duration. For the hockey player as shown in the drawings, the messages may typically include: A roar of the crowd, statement that Montreal wins the first professional hockey game 3-2 over Ottawa in 1882, and similar information. By way of example, the position sensitive switch 38 is a sealed horizontally positioned glass cylinder, with each end slightly curved upward from the center of the cylinder. The cylinder is partially filled with mercury or other conductive liquid and with a center electrode and an electrode in each opposite end. The cylinder, mounted in a horizontal position, is attached at the center of rotation of the inner knob 24 so that rotation of the knob in either direction causes the liquid to form an electrically conductive path between the center electrode and either end electrode. Formation of the conductive path connects the battery 32 to the microcircuit chip 34, initiating the generation of an electronic message. The message is applied by the chip 34 to the speaker 36 (FS-405, 0.4 watts, 8 ohms, Project Unlimited, Dayton, Ohio), creating one of the messages in audible form.

An alternative embodiment may also use a photoelectric cell to power the microcircuit chip in place of the batteries. Additionally, a ceramic transducer may be used to replace the speaker 36 to translate the electrical energy to an audible form.

As shown and described herein, alternative embodiments of the present invention may be apparent, however, the limitations should be determined from the claims hereinafter presented.

I claim:

1. A talking door knob assembly comprising:

a spindle shaft for extending through a door of a child's room past an inner and outer surface of the door, an outer door knob for attaching to and support by an outer end of the spindle shaft at the outer surface of the door, an inner door knob means for attaching to and support by an opposite inner end of the spindle shaft at the inner surface of the door and further comprising:

a turnable decorative knob shaped as a familiar childhood character, and an audio message generating means internally contained and rotationally controlled by the turnable decorative knob for projecting an audio message associated with and from the character into the child's room, and the audio message generating means further comprising a microcircuit for storing and releasing one or any of a plurality of electronic messages, each associated with the childhood character of the knob, the source of electrical energy for operating the microcircuit, actuating means for sensing an angular displacement of the turnable decorative knob and thereby transitioning from an open or non-conductive state to a closed or conductive state and actuating the microcircuit for releasing one of the stored messages, and energy conversion means for converting the electronic message to an audible message and projecting said audible message into the child's room.

2. The talking door knob assembly of claim 1 wherein the inner turnable decorative door knob shaped as a familiar childhood character is realistically colored and shaped from a plastic material.

3. The talking door knob assembly of claim 1 wherein the inner turnable decorative door knob shaped as a familiar childhood character is realistically colored and shaped from a metallic material.

4. The talking door knob assembly of claim 1 wherein the turnable decorative door knob contains inner compartments for mounting, containing and interconnecting the audio message generating means with a covered access for replacing a source of electrical energy stored within the assembly.

5. The talking door knob assembly of claim 1 wherein the energy source is an electrochemical cell.

6. The talking door knob assembly of claim 1 wherein the energy source is a photoelectric cell.

7. The talking door knob assembly of claim 1 wherein the actuating means is an orientation sensitive switch.

8. The talking door knob assembly of claim 1 wherein the energy conversion means for converting electrical energy to audio energy is a diaphragm loudspeaker.

9. The talking door knob assembly of claim 1 wherein the energy conversion means for converting electrical energy to audio energy is a ceramic transducer.

* * * * *